United States Patent [19]

Schulz

[11] 4,006,560

[45] Feb. 8, 1977

[54] CHRISTMAS TREE STAND

[75] Inventor: Donald A. Schulz, Milwaukee, Wis.

[73] Assignee: S-B Manufacturing Co. Ltd., Milwaukee, Wis.

[22] Filed: Feb. 9, 1976

[21] Appl. No.: 656,555

[52] U.S. Cl. ..... 47/40.5

[51] Int. Cl.[2] ..... A47G 33/12

[58] Field of Search ..... 47/40.5; 248/523–527

[56] References Cited

UNITED STATES PATENTS

| | | | |
|---|---|---|---|
| 3,411,740 | 11/1968 | Schulz | 47/40.5 |
| 3,591,114 | 7/1971 | Beatty | 47/40.5 |

*Primary Examiner*—Robert E. Bagwill

*Attorney, Agent, or Firm*—Wheeler, Morsell, House & Fuller

[57] ABSTRACT

A Christmas tree stand consisting of a water bowl with a down-turned rim and channel-shaped legs with slots complementary to the lip of the rim and abutments below the slots complementary to an abutment on the rim. A link extends from the end of the leg nearest the center of the bowl downwardly to the bottom of the bowl where it is secured against upward movement by a bracket attached to the bottom of the bowl, the bracket including an up-turned end having a sharp point to penetrate and immobilize the bottom of the tree trunk. The top end of each link and leg are threaded to receive a tree trunk engaging screw. As the trunk engaging screws are tightened to secure the tree trunk in an upright position at the center of the bowl, an outward force is applied to the top end of each link and the inner end of the corresponding leg, making the entire structure rigid. No ring encircling the trunk is required, permitting the insertion of a larger tree trunk and making it possible to leave the lower limbs of the Christmas tree on the trunk, rather than trimming them off to a height above the usual ring.

6 Claims, 6 Drawing Figures

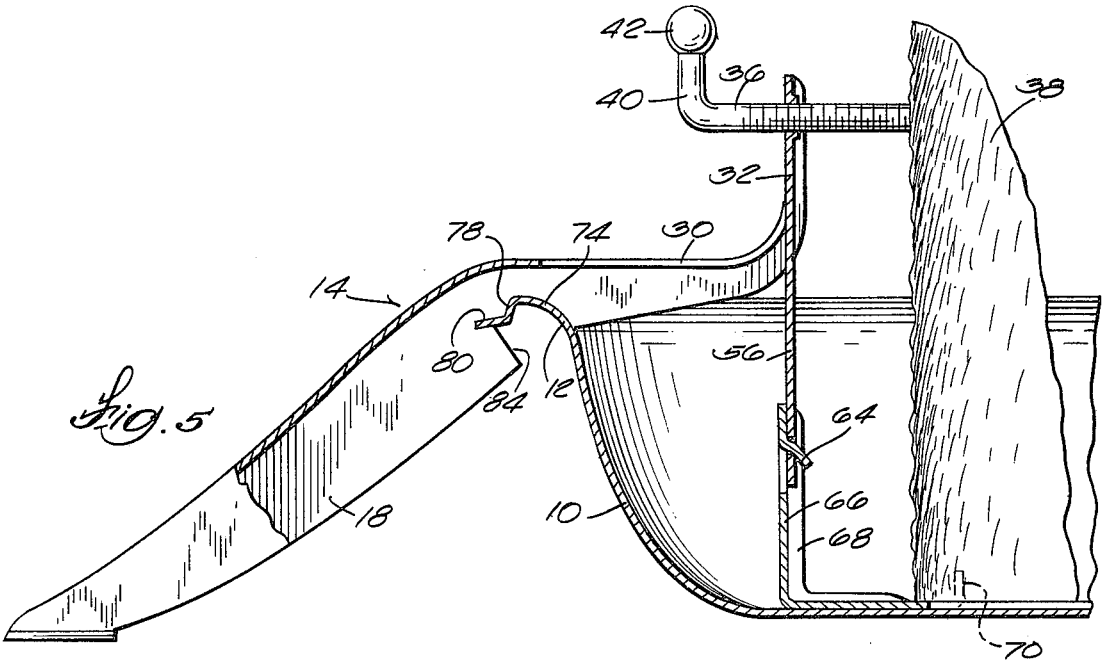
Fig. 5
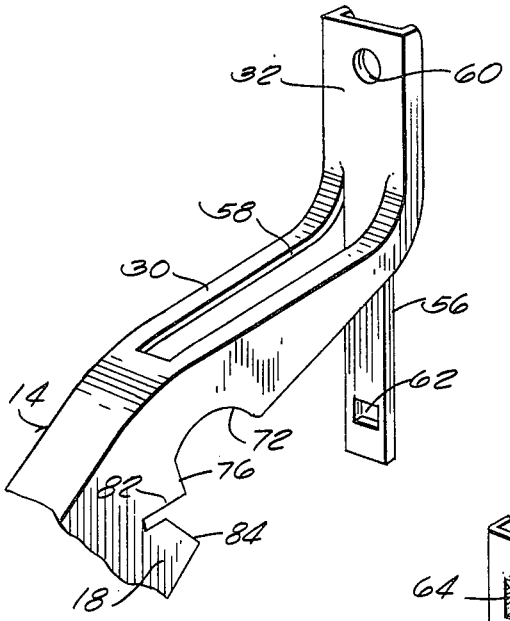
Fig. 6
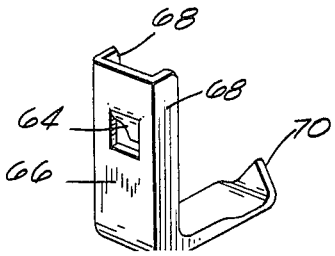

CHRISTMAS TREE STAND

BACKGROUND OF THE INVENTION

The tree stand which is subject of this application is an improvement of the tree stand of U.S. Pat. No. 3,411,740. While the structure of that patent functions very well, it had a drawback in common with all tree stands which are provided with a ring about the trunk at the level of the retaining screws, in that it required the trunk and limbs of the Christmas tree to be trimmed to a diameter which would pass through the ring from the bottom of the trunk to the top of the ring. This nearly always entailed the trimming of the large lower limbs of the tree and frequently required a reduction of the diameter of the trunk as well. Thus, a major object of this invention is to provide an easily assembled structure having sufficient physical strength and rigidity to safely hold Christmas trees, in which no ring is necessary to retain the inner end of the leg against outward movement as the tree trunk engaging screws are tightened against the tree trunk to secure the tree in an upright position. A further object is to assist in levelling the tree by causing limited leg movement as the trunk engaging screw is tightened.

Another object of this invention is to provide a Christmas tree holder of the above-noted type in which the tightening of the tree trunk engaging screws tends to lock the legs on the rim of the water bowl.

I am aware of the following prior patents which also lack a retaining ring:

U.S. Pat. No. 1,923,794;
U.S. Pat. No. 2,437,494;
U.S. Pat. No. 3,026,075;
U.S. Pat. No. 3,693,918;
Swedish Pat. No. 132,955.

Other objects and advantages of the invention will be apparent from the description herein.

Summary of the Invention

My invention consists in providing a Christmas tree stand of the type having a central watering bowl with a downturned rim to which a number of legs are pivotally secured, and having tree trunk engaging screws at the upper inner end of each leg, with a link extending downwardly from the tree trunk screw to the bottom of the watering bowl to serve as a reaction member making the entire structure rigid as the tree trunk engaging screw is tightened and the leg pivots slightly to align the tree. The outward force resulting from resistance to penetration of the tree trunk by the trunk engaging screw is exerted against the apex of a rough triangle consisting of the link, the leg, and the watering bowl. The shapes of each of the parts of the triangle is such that tension at the apex tightens all of the connections between the parts so that the triangle is rigid, securely positioning the tree in an upright position and securing the parts to one another while they are engaged. At the same time, when the screw is loosened, the legs and links are readily removed from their rather loose connections with each other and may be bundled together for storage. Subsidiary features of the invention include provision of a sharp tree engaging point at the inner end of the bracket securing the lower end of the link to the watering bowl, eliminating a separate part for that purpose and providing a very strong positioning point for the bottom of the tree trunk; provision of a hook and slot connection between the link and the watering bowl which is exceedingly secure when it is under tension but which falls apart readily when not under tension, and the provision of a larger unthreaded hole in the top of the leg in one form of the invention and the threaded hole in the top of the link for the tree trunk engaging screw for proper operation of the parts described.

DRAWINGS

FIG. 5 is a radial cross-sectional view of another form of the invention with a portion of the lower end of the leg shown in side elevational view.

FIG. 6 is an exploded perspective view showing the manner in which the parts of FIG. 5 other than the water bowl are assembled.

DETAILED DESCRIPTION

Figure 1:
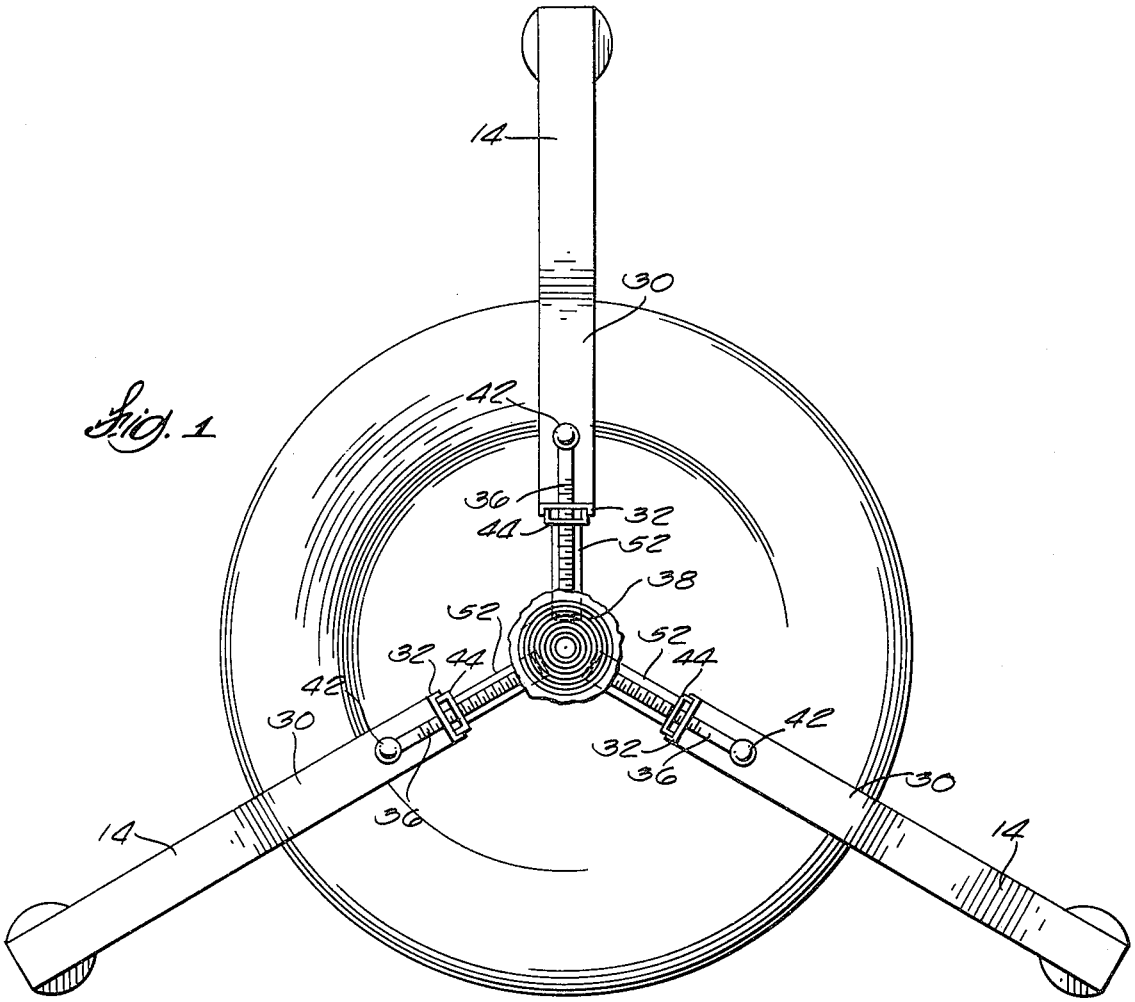
FIG. 1 is a top view of the tree stand of one form of my invention with a tree trunk in place therein.
Figure 2:
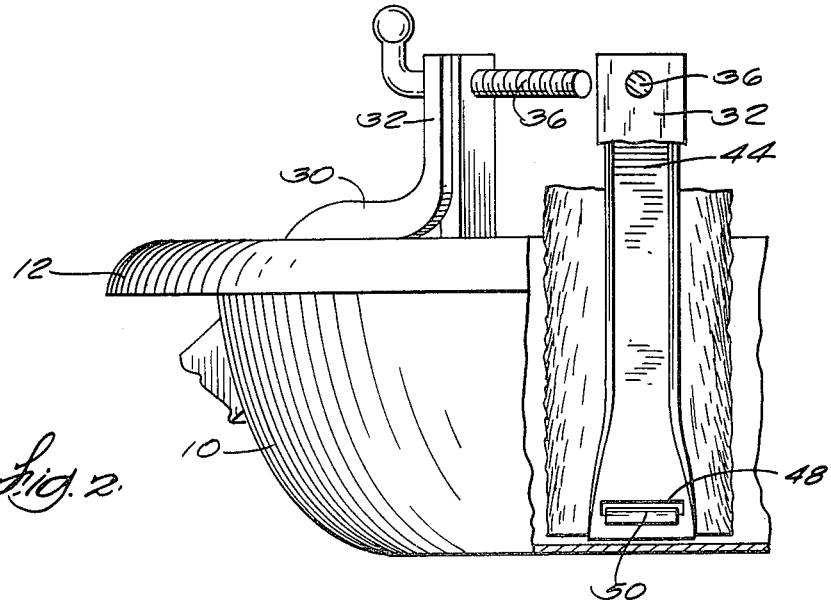
FIG. 2 is a greatly enlarged fragmentary side view of the tree stand of FIG. 1 with portions broken away for clarity of illustration.

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

Referring to FIGS. 1–4, one form of the invention includes a conventional water bowl 10 having a downturned rim 12 and three legs 14 which are removably connected to rim 12 at circumferentially spaced locations therearound. Each leg 14 is channel shaped in cross-section and has an upper web 16 from which two opposite sides 18 extend. Both sides 18 of each leg 14 have semi-circular notches 20 formed therein (FIG. 4) for engaging the top of downturned rim 12 and have slots 22 formed at the lower end of each notch 20 for engaging the lip 23 (FIG. 3) of downturned rim 12. A hook 24 (FIG. 4) having an upper abutment surface 25 is formed opposite each slot 22 for engaging a complementary abutment surface 26 (FIG. 3) formed in rim 12. Abutments 26 do not extend completely around the periphery of rim 12 but are rather formed at circumferentially spaced apart locations corresponding to the position of legs 14 in FIG. 1.

Legs 14 extend both inwardly and outwardly from their removable connection with rim 12 (FIG. 3), the outward lower leg portion being sloped downwardly and being shaped at its lower extremity 28 to rest on the floor, while the inward upper portion 30 extends horizontally toward the center of bowl 10 and terminates in an upwardly bent end 32 which has an opening 34 (FIG. 4) formed therein to receive a tree trunk engaging screw 36 which bears against a tree trunk 38 supported in an upright position in the center of bowl 10. Tree trunk engaging screws 36 preferably have a bent outer end portion 40 (FIG. 3) which terminates in a smooth knob 42 to enable screws 36 to be easily turned by hand.

Figure 3:
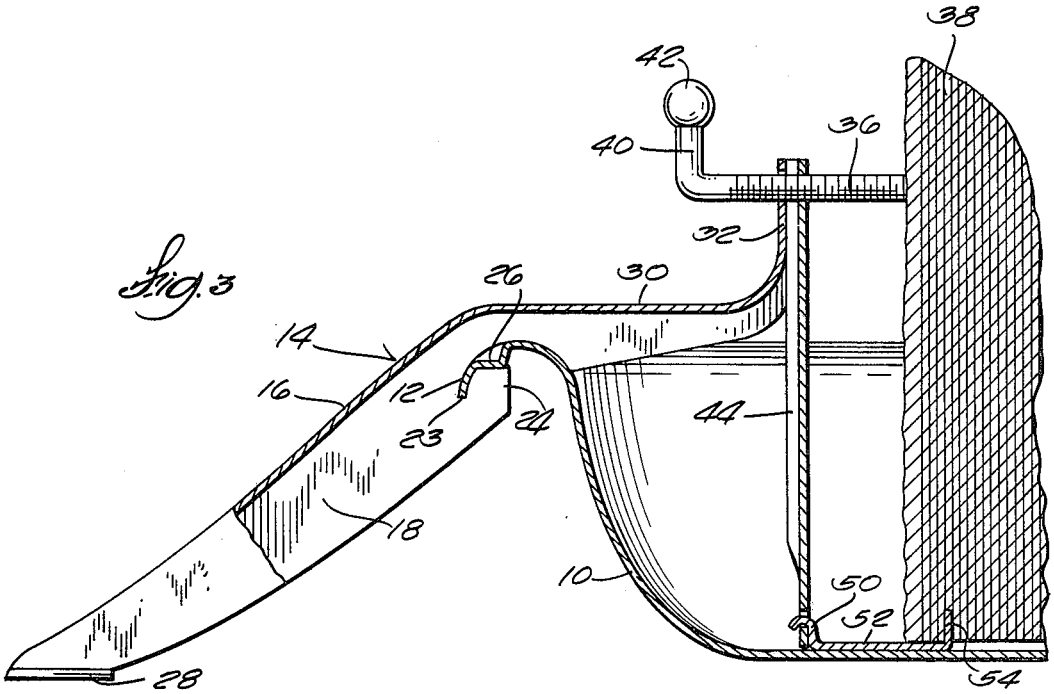
FIG. 3 is a radial cross-sectional view of the device of FIG. 1 with a portion of the lower end of the leg shown in side elevational view.
Figure 4:
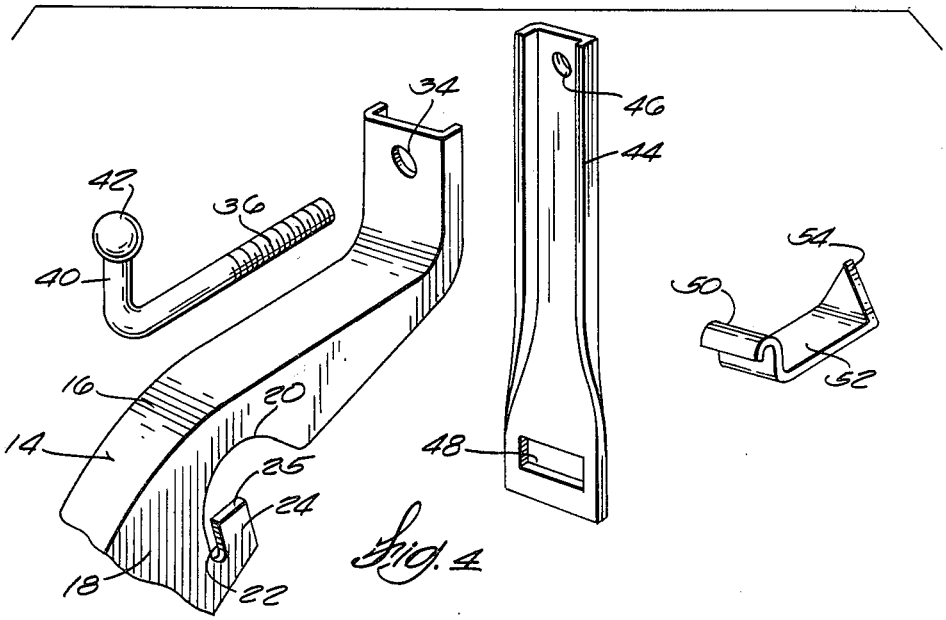
FIG. 4 is an exploded perspective view showing the manner in which the parts other than the water bowl are assembled.

A rigid upright link 44 which is channel shaped in cross-section (FIG. 4) is threaded at 46 near its upper end to receive the threaded portion of trunk engaging screw 36 and is slotted at 48 near its lower end to removably engage a hook 50 formed on a bracket 52 which is welded to the bottom of bowl 10. The other end of each bracket 52 is shaped in the form of an upwardly extending pointed end 54 which penetrates the bottom of tree trunk 38 as shown in FIG. 3 and holds it in position. There is one bracket 52 welded to the bottom of bowl 10 for each of the legs 14 and every bracket 52 is radially aligned with the corresponding leg 14. Similarly, there is one link 44 for each of the legs 14, and each link 44 is narrower in width than the inside width of the upper end portion 32 of legs 14 so that each link 44 will fit within the sides 18 of the corresponding leg portion 32 as shown in FIG. 1.

When any of the trunk engaging screws 36 is tightened so as to bear against tree trunk 38, outward pressure is applied to the apex of a substantially triangular configuration of supporting parts which include the upper portion 30 and upper end portion 32 of leg 14, rigid link 44 bracket 52, and the portion of bowl 10 and rim 12 that extends between bracket 52 and leg 14. As screw 36 is tightened, it causes the upper end of link 44 to move outwardly, which rotates the upper end of leg 14 outwardly (counterclockwise in FIG. 3) and causes abutment 25 on leg 14 to press upwardly against the complementary abutment 26 on rim 12 so as to tend to lock leg 14 onto rim 12. The rotation of leg 14 pulls up on link 44 and tends to lock link 44 to hook 50 on bracket 52. Thus, tightening of trunk engaging screws 36 tends to lock the removable connection between the corresponding leg 14 and rim 12 and between link 44 and hook 50. Loosening the trunk engaging screws 36 tends to loosen both removable connections so that either can be easily removed by hand. Links 44 are removed by manually disengaging the connection between slot 48 and hook 50, and legs 14 can then be removed by manually sliding each leg 14 circumferentially on rim 12 to disengage abutments 25 and 26 and then rotating the upper portion 30 of leg 14 upwardly (counterclockwise in FIG. 3) until lip 23 of rim 12 disengages from slot 22.

To mount legs 14 on bowl 10, the above-noted removal process is reversed, i.e slots 22 of each leg 14 are engaged with lip 23 of rim 12 and then the leg 14 is slid circumferentially until abutment 25 of leg 14 engages the corresponding abutment 26 on rim 12. The corresponding link 44 is then mounted by simply engaging slot 48 under hook 50.

FIGS. 5 and 6 show a different form of the invention in which the upper end 32 of each leg 14 is provided with a downwardly extending link 56 which serves the same purposes as link 44 but which is formed as an integral part of upper end 32 by being stamped out of the central portion of leg 14 leaving a slot 58 therein (FIG. 6). Link 56 is relatively narrow compared to the width of leg 14.

The upper ends 32 of legs 14 are threaded at 60 (FIG. 6) to receive tree trunk engaging screws 36 and slots 62 are formed in the lower end of links 56 for engaging hooks 64 in upstanding L-shaped brackets 66 which are welded to the bottom of bowl 10 in radial alignment with legs 14. Brackets 66 are channel shaped in cross-section to prevent sideways movement of links 56 which might disengage hooks 64 from slots 62. Links 56 are slightly narrower than the width of brackets 66. Brackets 66 have upstanding pointed ends 70 which are positioned to penetrate the bottom of tree trunk 38 as shown in FIG. 5 and hold it in position.

In this form of the invention, generally semi-circular notches 72 (FIG. 6) are formed in legs 14 to engage the rounded upper surface 74 (FIG. 5) of rims 12 and substantially vertical abutment surfaces 76 (FIG. 6) are formed on the outer end of notches 72 to interact with matching abutments 78 (FIG. 5) on rim 12. Rim 12 is bent in a straight lip 80 opposite abutment 78, and a straight slot 82 (FIG. 6) is provided under abutment 76 to receive lip 80. The abutment 78 and straight lip 80 do not extend completely around the periphery of rim 12 but are rather formed only at circumferentially spaced apart positions corresponding to the desired positions of legs 14.

The portion of the sides 18 of legs 14 immediately below slot 82 is cut along a line 84 to expedite engaging lip 80 in slot 82. In this form of the invention, leg 14 does not have to be slid circumferentially to engage lip 80 in slot 82 but rather can be easily engaged in the same circumferential position as lip 80.

The normal springiness of the steel from which legs 14 are formed imparts a degree of springiness to link 56 which enables slot 62 to ride up over hook 64 and then snap in place under hook 64 as shown in FIG. 5.

The form of the invention shown in FIGS. 5 and 6 is substantially the same in its action as the form shown in FIGS. 1–4. A triangular configuration of supporting members is formed by link 56, bracket 66, the upper portions 30 and 32 of leg 14, and the portion of bowl 10 extending between lip 80 and bracket 66. When tree trunk engaging screw 36 is tightened, it tends to lock the connection between leg 14 and rim 12 and between link 56 and bracket 66. When tree trunk engaging screw 36 is loosened, it loosens the connection between leg 14 and rim 12 and between 56 and bracket 66. This form of the invention, however, does differ slightly in that abutments 76 and 78 act to limit the inward movement of leg 14 rather than its outward movement, which is limited by the curved portion of notches 72 (FIG. 6).

I claim:

1. In a Christmas tree stand having a watering bowl, means stabilizing the tree trunk bottom with respect to the watering bowl, a plurality of legs removably connected at circumferentially spaced locations to the rim of said watering bowl and extending inwardly and outwardly therefrom, and having a tree trunk engaging screw attached to an upper portion of each of said legs, the improvement comprising a link removably connected between said upper portion of each leg and the bottom of said bowl to form a plurality of substantially triangular configurations of supporting members in which each tends to lock the corresponding leg to the rim of said bowl when the corresponding trunk engaging screw is tightened and tends to loosen the connection between said leg and the rim of said bowl when said trunk engaging screw is loosened.

2. The Christmas tree stand of claim 1 wherein said link is separate from said leg and is threaded at its upper end to receive said screw and is slotted at its lower end, and further comprising a plurality of hooks on the bottom of said bowl each positioned to engage the slotted end of a corresponding link.

3. The Christmas tree stand of claim 2 wherein each of said hooks are formed on one end of a corresponding bracket attached to the bottom of said bowl, and further comprising an upstanding pointed portion on the other end of each bracket for penetrating the bottom of a tree trunk to hold it in position on the bottom of said bowl.

4. The Christmas tree stand of claim 1 wherein said link is an integral part of said leg and extends downwardly from the upper end of said leg, and wherein said upper end of said leg is threaded to receive said screw, said link being slotted on its lower end, and further comprising a plurality of hooks on the bottom of said bowl each positioned to engage the slotted end of a corresponding link.

5. The Christmas tree stand of claim 4 wherein each of said hooks are formed on one end of a corresponding bracket attached to the bottom of said bowl, said trunk stabilizing means comprising an upstanding pointed portion on the other end of each bracket for penetrating the bottom of a tree trunk to hold it in position on the bottom of said bowl.

6. The Christmas tree stand of claim 5 wherein said bracket is substantially L-shaped, said hook being formed in the stem portion of said L-shape, said stem portion being channel shaped in cross-section, and said link being narrow enough to fit between the sides of said stem portion.

* * * * *